United States Patent [19]

Propst

[11] 4,261,433

[45] Apr. 14, 1981

[54] ACOUSTICAL-REFLECTIVE CEILING CONSTRUCTION

[75] Inventor: Robert L. Propst, Ann Arbor, Mich.

[73] Assignee: Herman Miller, Inc., Zeeland, Mich.

[21] Appl. No.: 11,181

[22] Filed: Feb. 12, 1979

[51] Int. Cl.[3] ..... E04B 1/82; E04B 5/62

[52] U.S. Cl. ..... 181/286; 181/288; 181/289

[58] Field of Search ..... 181/284, 286, 289, 30, 181/295, 293, 288; 52/144, 145; 362/148, 342

[56] References Cited

U.S. PATENT DOCUMENTS

| | | | |
|---|---|---|---|
| 1,554,179 | 9/1925 | Trader | 181/293 |
| 2,850,109 | 9/1958 | Benjamin | 181/289 |
| 2,954,838 | 10/1960 | Nuorivaara | 52/145 |
| 3,068,956 | 12/1962 | Cooley | 181/289 |
| 3,087,577 | 4/1963 | Prestia | 52/144 |

FOREIGN PATENT DOCUMENTS 676224 2/1930 France .

*Primary Examiner*—L. T. Hix
*Assistant Examiner*—Benjamin R. Fuller
*Attorney, Agent, or Firm*—Olsen and Stephenson

[57] ABSTRACT

An acoustical-reflective ceiling panel for directing incident light from a remotely positioned light source toward a selected area and for attenuating ambient noise. The panel includes a plurality of pyramidal reflector units arranged in an array of rows and columns and a plurality of acoustical holes which trap the ambient noise to thereby reduce the noise level in the vicinity of the panel. The pyramidal reflector units each have reflective surfaces facing in different directions and are located in staggered rows in which the pyramidal reflector units in alternate rows form the columns. Light emitted from a light source positioned laterally with respect to the pyramidal reflector units is reflected off those reflective surfaces that face the light source onto the selected surface area.

2 Claims, 4 Drawing Figures

ACOUSTICAL-REFLECTIVE CEILING CONSTRUCTION

BACKGROUND OF THE INVENTION

Figure 1:
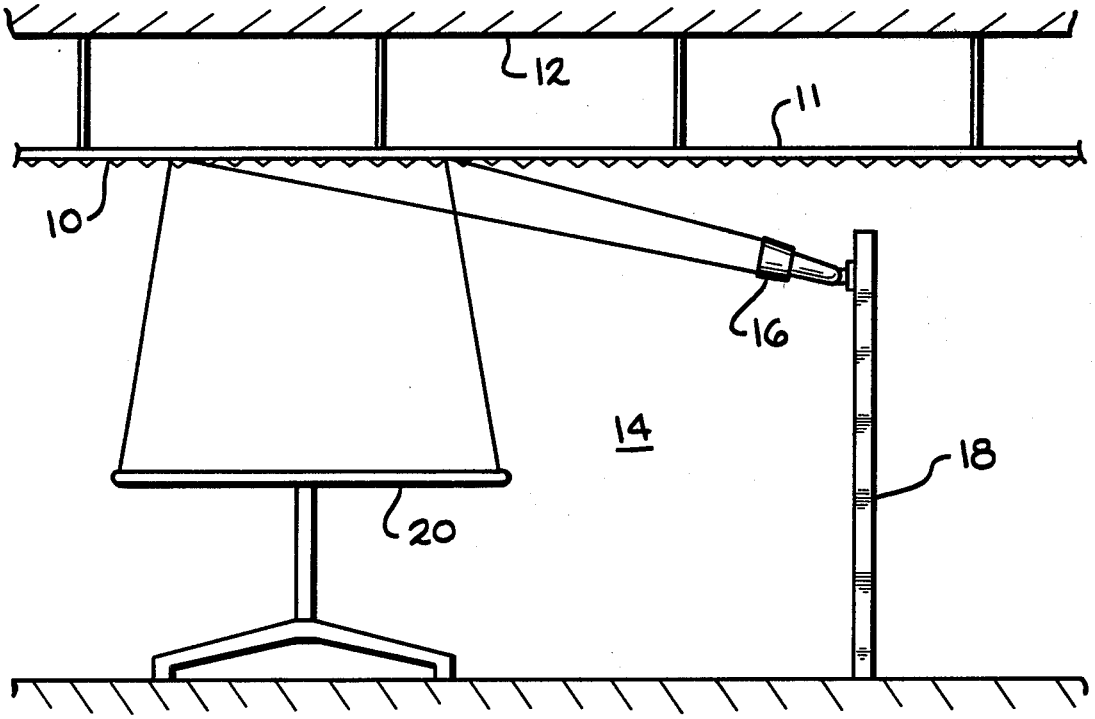

The present invention provides an improved acoustical-reflective ceiling panel.

In work areas, especially those which lack ceiling-mounted light fixtures, it is difficult to provide adequate lighting. One solution is to provide free-standing light fixtures which can be strategically placed to adequately illuminate the work area. These free-standing light fixtures, however, may inhibit free movement of people in the work area, and since they are usually plugged into outlets with cords, safety procedures must be implemented and stringently followed to avoid injury. Also in those instances when it is necessary for a person to position himself between the light source on the free-standing fixture and the work area, annoying shadows play across the work area. Thus, it is desirable that the illumination has its source located directly above the work area.

Recent studies have shown that there is a correlation between human tension and the level of noise in the environment. Consequently, employee morale and efficiency can be improved if the noise level in the work area is maintained within an optimum range. Installation and maintenance cost savings can be realized if a light reflective system and a sound attenuating system are combined in a single unitary construction.

Attempts have been made to illuminate selected areas by reflecting light off a specially constructed reflective ceiling panel. One such attempt is disclosed in French Pat. No. 676,224. This patent illustrates a plurality of wall-mounted lights directed upwardly toward the center of a room onto a reflective concave mirror suspended from the ceiling. The light is thus reflected essentially downwardly from the ceiling. However, the concave reflective surface fails to efficiently redirect light from a single source onto the selected surface area which necessitates the use of multiple lights. Also, there is no disclosure regarding a light reflective unit capable of absorbing noise. U.S. Pat. No. 3,068,956 discloses an acoustico-illuminative tile consisting of a plurality of regularly arranged pyramidal units each having triangular faces. Selected ones of each face are provided with reflective surfaces while the remaining faces are provided with either sound-absorbing or sound-reflective coatings. The pyramidal units can be oriented so as to reflect or absorb light and sound from a variety of directions. Since some of the surfaces of the pyramidal units are nonreflective, it becomes necessary to reorient the units if the position of the light source is varied.

Finally, U.S. Pat. No. 2,710,335 discloses a modular lighting fixture having translucent chambers through which light is transmitted. The translucent material functions to eliminate undesirable glare. The chambers extend downwardly from the panel and are arranged in regular rows and columns. This patent, however, fails to disclose a reflective ceiling panel capable of reflecting light from a wall-mounted light.

It is the general object of this invention, therefore, to provide an improved acoustical-reflective ceiling panel.

SUMMARY OF THE INVENTION

In accordance with the present invention, an acoustical-reflective ceiling panel is disclosed consisting of a plurality of spaced-apart pyramidal reflector units arranged in parallel rows and columns. The pyramidal reflector units are surrounded by acoustical holes formed in the panel whose function is to trap ambient noise in the vicinity of the panel. Each pyramidal reflector unit consists of a plurality of triangular reflective surfaces each having a vertex, sides, and a base. The reflective surfaces are arranged so that adjacent ones have contiguous sides with all triangular reflective surfaces of each unit having a common vertex. Accordingly, the corresponding reflective surfaces on the reflector units are angularly disposed to face downwardly and outwardly in common directions. Each reflective surface has a slightly convex configuration so as to efficiently reflect incident light from a wall-mounted light source onto a selected work area.

Adjacent rows of the reflector units are staggered with respect to each other so that the columns of the reflector units are defined by those reflector units in alternate rows. Thus, a reflector unit in one row bridges the columnar space between adjacent reflector units in the next row.

The acoustical holes are formed by walls that converge in directions extending into the panel. In the disclosed embodiment, the holes extend through the panel so that the noise traverses through the holes to the side of the panel opposite the side where the noise originates. Sound absorbing material can be disposed behind the panel to enhance the noise-attenuating ability of the ceiling panel.

The ceiling panel is suspended from a ceiling so that the reflective surfaces of each reflector unit face downwardly in directions extending outwardly of the units. A wall-mounted light positioned at a height dependent on the angular orientation of the reflective surfaces is directed onto the ceiling panel. Therefore, incident light from the light source is reflected downwardly in generally perpendicular directions with respect to the ceiling wall panel onto a selected area such as a table. Accordingly, ceiling-mounted and free-standing light fixtures become unnecessary in environments incorporating this invention.

Figure 3:
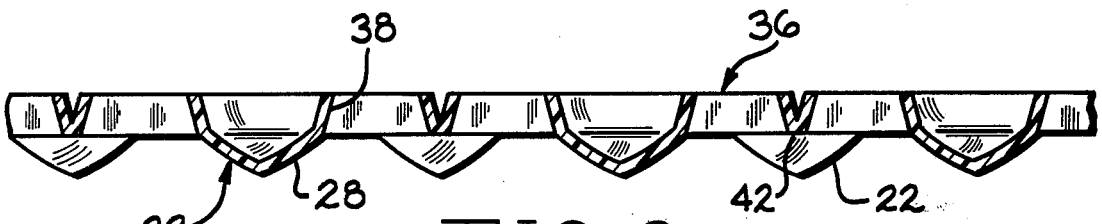
Figure 4:
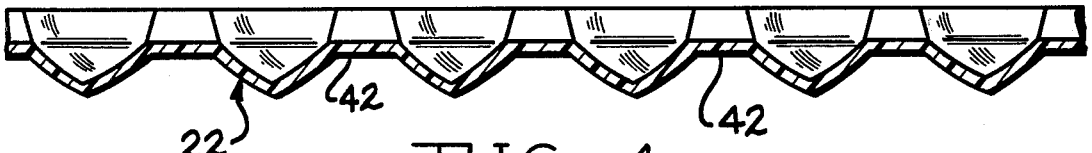
Figure 2:
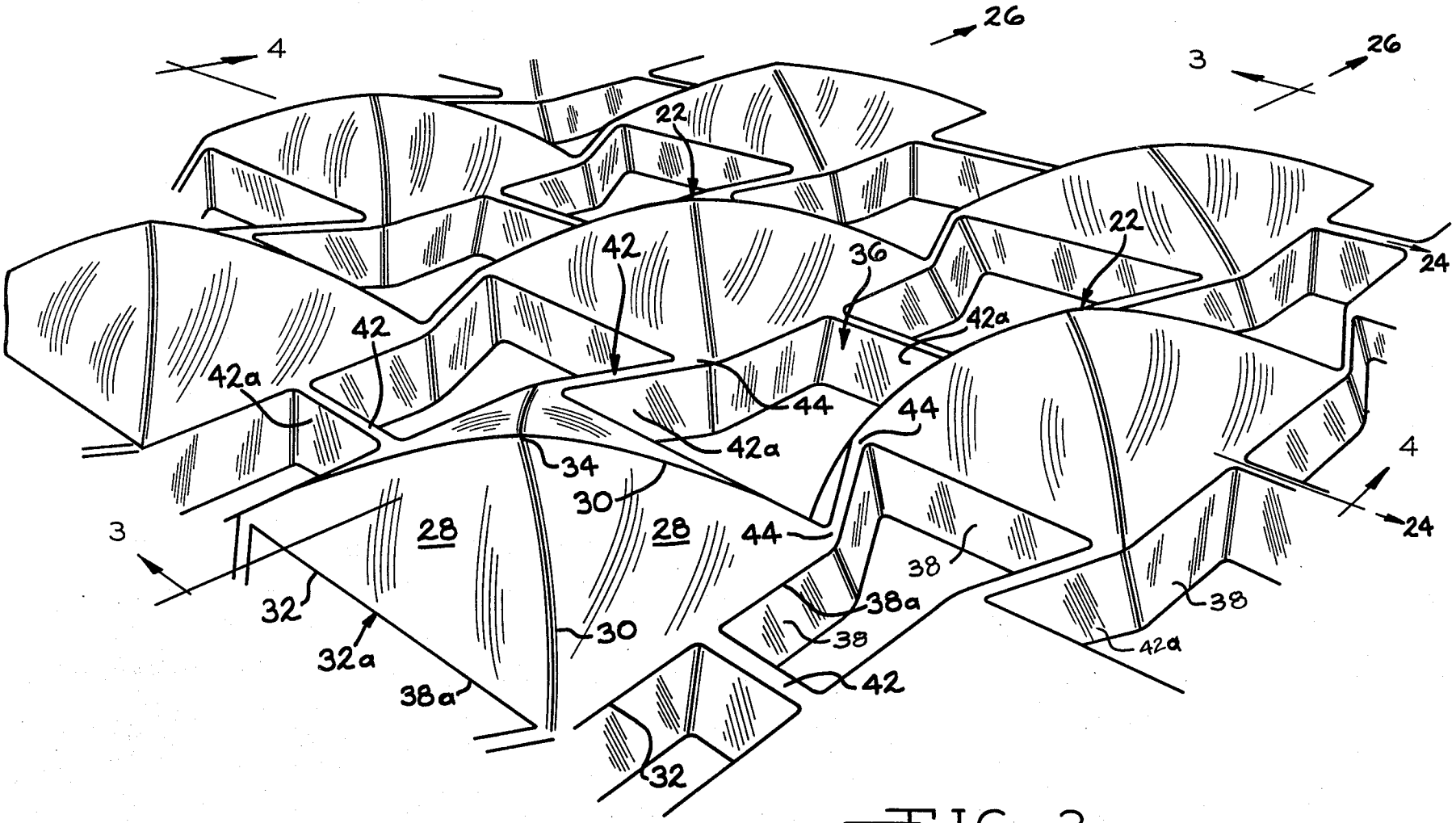

Further objects, features, and advantages of the present invention will become apparent from a consideration of the following description when taken in connection with the appended claims and the accompanying drawing in which:

FIG. 1 is an elevational view showing the acoustical-reflective ceiling panel of the present invention suspended from a ceiling and reflective incident light onto a table;

FIG. 2 is a perspective view of the acoustical-reflective ceiling panel of the present invention shown inverted for purposes of clarity; and FIGS. 3 and 4 are sectional views of the acoustical-reflective ceiling panel taken respectively from lines 3—3 and 4—4 in FIG. 2.

With reference to the drawing, the acoustical-reflective ceiling panel, indicated generally at 10, is shown in FIG. 1 suspended from a permanent ceiling 12 in a room 14. The ceiling panel 10 is provided with reflective surfaces enabling the panel to reflect incident light from a light source 16 which is mounted on a wall or partition 18 onto a selected area such as the table 20.

As shown in FIGS. 2–4, the acoustical-reflective panel 10 consists of a plurality of spaced-apart pyramidal reflector units 22 arranged in parallel rows 24 and parallel columns 26. Each reflector unit 22 consists of four triangular reflective surfaces 28 each of which having sides 30, a base 32, and a vertex 34. Each reflective surface 28 is slightly convex enhancing its light-distributing capability, as can best be seen in FIGS. 3 and 4. The reflective surfaces 28 are arranged so that adjacent surfaces 28 have contiguous sides 30. The bases 32 of each unit 22 form a polygonal pyramid base 32*a* which is shown as being generally rectangular. The triangular reflective surfaces 28 all have their vertices 34 located at a common position so that the reflective surfaces 28 face in directions in which adjacent surfaces 28 face in directions that are at right angles with each other. The reflector units 22 are oriented so that corresponding ones of the reflective surfaces 28 face in common directions. In other words, the reflective surface 28 on each reflector unit 22 face in four directions with the corresponding reflective surfaces 28 on the remaining reflector units 22 facing in the same directions.

Irregularly shaped acoustical holes 36 are formed in the panel 10 to surround the reflector units 22 and serve to trap the ambient noise. The acoustical holes 36 are defined by side walls 38 having borders 38*a* coincidental with the bases 32 of the reflective surfaces 28. The side walls 38 extend away from the bases 32 in directions that are essentially opposite to the directions which the reflective surfaces 28 face. In the illustrated embodiment, the holes 36 extend entirely through the panel 10 so that the sound waves traverse to the backside of the panel 10 which is opposite the side of the panel 10 where the sound originated. As a result, there is a decreased likelihood that the sound waves will return through the holes 36 after being directed to the backside of the panel 10.

The acoustical holes 36 are also defined by rib members 42 having sidewalls 42*a* which extend between and connect adjacent reflector units 22. The walls 38 and 42*a* converge in directions extending toward the backside of the panel 10 to aid in directing the sound waves through the holes 36.

As shown in FIG. 2, the reflector units 22 in one row 24 are staggered with respect to the reflector units 22 in an adjacent row 24 so that the columns 26 of the reflector units 22 are defined by those reflector units 22 in alternate rows 24. The bases 32 together form a generally rectangular pyramid base 32*a* having corners 44. The corner 44 of one reflector unit 22 is connected to the closest corner 44 of an adjacent reflector unit 22 in the adjacent row 24 by a rib member 42. Also, the facing side walls 38 on adjacent reflector units 22 within one row 24 are connected by rib members 42 at positions essentially midway between the corners 44 of the units 22. Thus, each reflector unit 22 is surrounded by six acoustical holes 36 which have a funnel shape.

Each reflector unit 22 in one row extends across and beyond the columnar space formed between adjacent reflector units 22 in the next row 24 since the length of each base 32 is greater than the distance between the side walls 38 of adjacent reflector units 22 in a row 24. The size and arragement of the reflector units 22 along with the rib members 42 give the recesses funnel-shaped configurations.

Assume the acoustical ceiling panel 10 is mounted on or suspended from a ceiling in the room 14. The reflective surfaces 28 are disposed to face in generally downwardly and outwardly facing directions. The light 16 is mounted at a selected height on the wall partition 18 which is dependent upon the angular orientation of the reflective surfaces 28 so that when the light is directed onto the ceiling panel 10 above the table 20, the incident light on the reflective faces 28 that face in the direction of the light 16 will be reflected vertically downwardly onto the table 20. Sound-dampening material 11 is positioned adjacent the backside of the panel 10, as seen in FIG. 1. The material 11 can be mounted on the panel 10 or it can be suspended from the permanent ceiling 12 adjacent to and spaced slightly from the panel 10. Sound waves traversing through the holes 36 will thus be absorbed by the material 11 to further aid in attenuating ambient noise.

As can be seen, an improved acoustical-reflective ceiling panel 10 has been described in which the pyramidal units 22 have a plurality of reflective faces 28. Accordingly, the light 16 is thereby afforded. The side walls, rib members, and reflectors all cooperate to redirect ambient noise through the holes 36. The ceiling panel 10 can be molded to form a unitary structure thereby reducing manufacturing costs and providing a ceiling panel that is highly efficient and economical in use. The dual light-reflective and sound-dampening functions of the ceiling panel 10 makes it desirable for use in work areas wherein it is desirable to reduce the ambient noise enabling the workers to efficiently carry out their tasks.

What is claimed:

1. An acoustical-reflective panel for directing incident light toward a selected area and for attenuating ambient noise, said panel comprising a plurality of spaced-apart pyramidal reflector units disposed in a predetermined arrangement, each of said reflector units having a polygonal base and a plurality of triangular reflective side surfaces disposed to face in different directions, corresponding ones of said reflective surfaces on said reflector units being disposed to face in a common direction so that incident light emitted from a light source located at a position spaced away from and at an angle with said panel will reflect off corresponding ones of said reflective surfaces onto said selected area, and rib means connecting said spaced-apart reflector units so as to form a plurality of acoustical openings of irregular configuration extending through said panel in substantially all areas of said panel between said spaced-apart reflector units to trap ambient noise thereby reducing the noise level in the vicinity of said panel, said acoustical openings having wall means converging in a direction extending into said panel so as to aid in directing sound waves through said acoustical openings.

2. An acoustical-reflective panel for directing incident light toward a selected area and for attenuating ambient noise, said panel comprising a plurality of spaced-apart pyramidal reflector units disposed in a predetermined arrangement, each of said reflector units having a polygonal base and a plurality of triangular reflective side surfaces disposed to face in different directions, corresponding ones of said reflective surfaces on said reflector units being disposed to face in a common direction so that incident light emitted from a light source located at a position spaced away from and at an angle with said panel will reflect off corresponding ones of said reflective surfaces onto said selected area, and means forming a plurality of acoustical openings of irregular configuration extending through said panel at positions between adjacent reflector units to trap ambient noise thereby reducing the noise level in the vicinity of said panel, said acoustical openings having wall means converging in a direction extending into said panel so as to aid in directing sound waves through said acoustical openings, said reflector units being arranged in an array of rows and columns, the reflector units in one row being staggered with respect to the reflector units in an adjacent row so that said columns are formed by the reflector units in alternate rows, said acoustical openings being arranged in pairs in said rows so as to alternate pairs of said openings with single ones of said reflector units in each row and provide for pairs of openings on opposite sides of at least some reflector units in each column, and rib members bounding said openings and connecting adjacent reflector units in said rows and said columns.

* * * * *